US009373884B2

(12) United States Patent
Göttl et al.

(10) Patent No.: US 9,373,884 B2
(45) Date of Patent: Jun. 21, 2016

(54) DUAL-POLARISED, OMNIDIRECTIONAL ANTENNA

(71) Applicant: Kathrein-Werke KG, Rosenheim (DE)

(72) Inventors: Maximilian Göttl, Frasdorf (DE); Manfred Stolle, Bad Aibling (DE)

(73) Assignee: KATHREIN-WERKE KG, Rosenheim (DE)

( * ) Notice: Subject to any disclaimer, the term of this patent is extended or adjusted under 35 U.S.C. 154(b) by 376 days.

(21) Appl. No.: 13/708,312

(22) Filed: Dec. 7, 2012

(65) Prior Publication Data

US 2014/0159978 A1 Jun. 12, 2014

(51) Int. Cl.

| | |
|---|---|
| ***H01Q 21/00*** | (2006.01) |
| ***H01Q 1/24*** | (2006.01) |
| ***H01Q 15/14*** | (2006.01) |
| ***H01Q 21/20*** | (2006.01) |
| ***H01Q 21/24*** | (2006.01) |
| ***H01Q 21/26*** | (2006.01) |
| ***H01Q 25/00*** | (2006.01) |

(52) U.S. Cl.

CPC ..... *H01Q 1/246* (2013.01); *H01Q 15/14* (2013.01); *H01Q 21/205* (2013.01); *H01Q 21/24* (2013.01); *H01Q 21/26* (2013.01); *H01Q 25/001* (2013.01)

(58) Field of Classification Search

CPC ..... H01Q 1/246; H01Q 15/14; H01Q 25/001; H01Q 21/24; H01Q 21/26; H01Q 21/205

USPC ..... 343/817, 810, 890, 891, 892, 815

See application file for complete search history.

(56) References Cited

U.S. PATENT DOCUMENTS

| | | | | |
|---|---|---|---|---|
| 5,969,689 | A | 10/1999 | Martek et al. | |
| 5,999,145 | A * | 12/1999 | Niekamp | 343/890 |
| 6,369,774 | B1 | 4/2002 | Lucidarme | |
| 6,512,934 | B2 * | 1/2003 | Ihara et al. | 455/562.1 |
| 7,015,871 | B2 * | 3/2006 | Gottl et al. | 343/882 |

(Continued)

FOREIGN PATENT DOCUMENTS

| | | |
|---|---|---|
| DE | 198 60 121 | 7/2000 |
| DE | 10316787 A1 | 11/2004 |
| DE | 600 19 412 T2 | 1/2006 |

(Continued)

OTHER PUBLICATIONS

Publication "Antennen and Antennensysteme", Institut Für Höchstfrequenztechnik Und Elektronik, 4 pages.

(Continued)

*Primary Examiner* — Hoanganh Le
(74) *Attorney, Agent, or Firm* — Nixon & Vanderhye P.C.

(57) ABSTRACT

An improved dual-polarized, omnidirectional antenna is characterized inter alia by the following features:

each sector antenna (5) comprises at least one antenna gap (6) comprising an associated reflector (11), which is arranged at least in part in a reflector plane (13'), at least one dual-polarized radiator (7, 9) being arranged in the antenna gap (6), in front of the reflector (11)

the sector antennae (5) are additionally arranged mutually offset along the central axis (1) thereof, the sector antennae (5) are arranged in such a way that, in an axial view along the central axis (1), the reflector walls (13), arranged in a respective reflector plane (13'), of the reflectors (11), overlap or intersect.

19 Claims, 11 Drawing Sheets

(56) References Cited

U.S. PATENT DOCUMENTS

| | | | | |
|---|---|---|---|---|
| 7,023,398 | B2 * | 4/2006 | Gottl et al. | 343/872 |
| 2008/0036674 | A1 | 2/2008 | Riedel et al. | |

FOREIGN PATENT DOCUMENTS

| | | | |
|---|---|---|---|
| DE | 69734172 | T2 | 6/2006 |
| DE | 10 2004 057 774 | | 7/2006 |
| DE | 102007060083 | A1 | 6/2009 |
| EP | 0802579 | A2 | 10/1997 |
| EP | 1 082 782 | | 7/2003 |
| EP | 1 057 2024 | | 10/2003 |
| EP | 1 470 615 | | 7/2005 |
| GB | 2383689 | A | 7/2003 |
| GB | 2410838 | A | 8/2005 |
| JP | 9-284045 | A | 10/1997 |
| JP | 2006-25018 | | 1/2006 |
| JP | 2009-290654 | A | 12/2009 |
| JP | 2011-10081 | A | 1/2011 |
| WO | 99/62139 | A1 | 12/1999 |
| WO | 03/065505 | A1 | 8/2003 |
| WO | 2007/069809 | A1 | 6/2007 |
| WO | 2008/017386 | A1 | 2/2008 |
| WO | WO 2011/120090 | | 10/2011 |
| WO | 2012/096544 | A2 | 7/2012 |

OTHER PUBLICATIONS

German Search Report dated Jun. 7, 2013, issued in German Application No. 102012023938.6.

English translation of the International Preliminary Report on Patentability mailed Nov. 16, 2015, issued in International Application No. PCT/EP2013/003355.

* cited by examiner

DUAL-POLARISED, OMNIDIRECTIONAL ANTENNA

The invention relates to a dual-polarised, omnidirectional antenna in accordance with the preamble of claim 1.

An omnidirectional antenna is known for example from WO 2011/120090 A1. An omnidirectional antenna of this type comprises for example three antenna array arrangements, which are each arranged mutually offset at a 120° angle about a central axis, resulting in a triangular construction in an axial plan view. As a result, each antenna array can cover approximately an azimuth angular range of 120°.

Each of the three antenna arrays, which are arranged mutually offset, comprises for example a plurality of dual-polarised radiator means, arranged with equal spacing above one another. The respective dual-polarised radiators are supplied by way of a corresponding supply means. In this context, the radiators can also be supplied in a circular manner. As is conventional, the two polarisation planes are preferably arranged not only vertically, but also in an angular range of +45° or −45° with respect to a horizontally or vertically established plane, rather than being mutually perpendicular.

Further, the individual sector antennae may be made MIMO capable, and thus be part of a receiving system comprising a plurality of input and output signals.

A vertically polarised antenna is also known for example from DE 600 19 412 T2. It comprises a vertical, elongate support structure comprising a plurality of dipoles, which are arranged at various heights along the support structure and are connected to a coaxial power supply cable. Only one dipole per vertical step is provided along said structure. In this context, the dipoles are attached so as to be coplanar and precisely collinear, specifically divided into two groups which are formed in succession on said structure. The dipoles in the two groups are orientated in the opposite direction from one another, in such a way that the horizontal polarisation components of the two groups extend counter to one another. In this context, the arrangement is such that there is a small distance between the two dipole groups, which makes it possible to equalise the phase centres of the dipoles of the two groups, and thus to compensate a slight shift due to the effect of the earth plane on the dipoles.

In addition, vertically polarised omnidirectional antennae are known which only emit or receive in one polarisation and are not MIMO capable. These vertically polarised omnidirectional antennae, comprising for example three or four panels, are interconnected around a mast in a single plane so as to form an omnidirectional radiation pattern. For better omnidirectionality, a plurality of planes may also be interconnected rotationally offset. The drawback of this is that good omnidirectional radiation properties are only possible for a small frequency range (in this context the geometric arrangement results in phase-dependent cancellations).

Starting from the generic prior art mentioned at the outset, the object of the present invention is to provide an improved dual-polarised and also omnidirectional antenna or antenna group, which has an improved omnidirectional radiation property by comparison with conventional solutions whilst being as compact as possible.

The invention is achieved in accordance with the features specified in claim 1. Advantageous configurations of the invention are specified in the dependent claims.

The solution according to the invention is distinguished in that a plurality, for example three, of sector antenna means, in particular antenna arrays, which are mutually offset for example by 120° can be provided, but unlike in the generic prior art are positioned mutually offset in the vertical direction, that is to say in the installation direction thereof, rather than in the same vertical position. This provides the possibility of each individual sector antenna being mounted offset from the central or installation axis thereof counter to the radiation direction thereof (unlike in the generic prior art), in such a way that in a plan view of the various sector antennae the phase centres ultimately come to be superposed. In this context, a phase centre is understood to mean the electronic reference points of an antenna from which the electromagnetic antenna radiation appears to originate as viewed from the receiving location.

Since this reference point is thus identical for all the sector antennae, a striking improvement in the omnidirectional radiation properties is thus achieved.

Since all the sector antennae are thus arranged closer to the central vertical or installation axis, this results overall in a smaller antenna arrangement in terms of diameter, albeit with a greater total vertical height. Since the diameter of the overall arrangement is much smaller in the context of the invention than in a prior art solutions, the optical effect of the overall arrangement is also smaller in the context of the invention. Further, the wind loading is also reduced with the solution according to the invention.

In a preferred embodiment of the invention, in this context the at least one reflector plane of each sector antenna is arranged in such a way that the vertical central axis extends through all the reflector planes or is arranged extending at a distance therefrom which is much smaller than the distance in accordance with the prior art. This is because the reflector plane can generally be designated at least approximately as a phase centre, that is to say usually the central region of a corresponding reflector of a sector antenna.

In this context, the invention also provides the advantage that, for the horizontal pattern, the phase centre of the overall arrangement is identical to the phase centre of an individual antenna. As a result, the group factor of the overall arrangement is frequency-independent and the omnidirectional radiation pattern is thus extremely wide-band (and is thus also suitable for dual-band antennae). The omnidirectional nature of the overall arrangement only remains dependent on the FWHM of the individual antenna.

In a preferred embodiment of the invention, a decoupling-optimised construction of the individual radiators or directional antennae is further provided. This may for example comprise reflector bars which are peripheral or peripheral in portions, above all reflector bars which are positioned transverse to the respective reflector plane and are formed between the individual sector antennae which are arranged vertically above one another.

It is likewise possible in the context of the invention not only to provide an omnidirectional single-band antenna, but also for example to provide an omnidirectional dual-band antenna or a multi-band antenna having even more bands, which may also transmit and/or receive in a dual-polarised or circular-polarised manner.

This can preferably be achieved using suitable radiators and radiator devices, for example in the form of patch radiators, but also in the form of what are known as dipole or vector radiators, such as are known for example from EP 1 082 728 B1 and EP 1 470 615 B1. In particular in the latter prior publication, it is shown that what are known as cup-shaped dual-polarised radiators, of slightly greater dimensions, and dual-polarised radiators of smaller dimensions, which are positioned in the centre thereof and are provided for the higher frequency band range, can be used.

In the context of preferred embodiments and developments of the invention, it is also possible to increase the number of radiators in a compact manner, in that, for example at each location at which a sector antenna is provided, a further sector antenna radiating in the opposite direction is used, based on the same reflector plane. Thus, in effect a double sector antenna which radiates in opposite directions is provided at each mounting site.

Likewise, in general a plurality of single-band, dual-band or multiband radiators or radiator means can be arranged vertically above one another in each antenna gap, as in an otherwise conventional antenna. Each of these antenna gaps having the plurality of radiators arranged above one another is subsequently arranged, that is to say orientated, offset in the circumferential direction about the central axis, that is to say with different azimuth angles. This makes it possible to double the radiators as described above in that radiator means which are orientated in the opposite direction are provided on the basis of the same reflector plane (that is to say offset by 180°).

If for example two antenna gaps having corresponding radiator means are used, the single plane in which the phase centres of a gap antenna are positioned, or at least approximately positioned, can be arranged in such a way that it extends preferably through the central axis or in the vicinity of the central axis.

By contrast, however, in a development of the invention it is possible to provide a further or a double further sector antenna, positioned offset radially outwards from the vertical central axis, in the same vertical position as a radiator device. In other words, in an antenna arrangement of this type (such as the sector antenna), for example having two gaps, the radiators in one gap could be arranged in such a way that the phase centres thereof come to be positioned precisely, or as precisely as possible, with respect to the respective central axis of the antenna arrangement, and subsequently the radiator means which are arranged in an associated for example second antenna gap come to be positioned radially, that is to say laterally, offset from the central axis, and thus the two gaps are not positioned symmetrically about the central axis. This also provides further advantages, even if this further sector antenna is positioned at a greater radial distance from the vertical central axis. As a result, a plurality of multi-gap antennae having higher MIMO modes can be provided, in which, although the phase centres are not identical, an optimum omnidirectional nature of the radiation pattern can nevertheless be achieved along with a high band width.

Further advantages, details and features of the invention may be taken from the embodiments described in the following. In particular, in the drawings.

Figure 1:
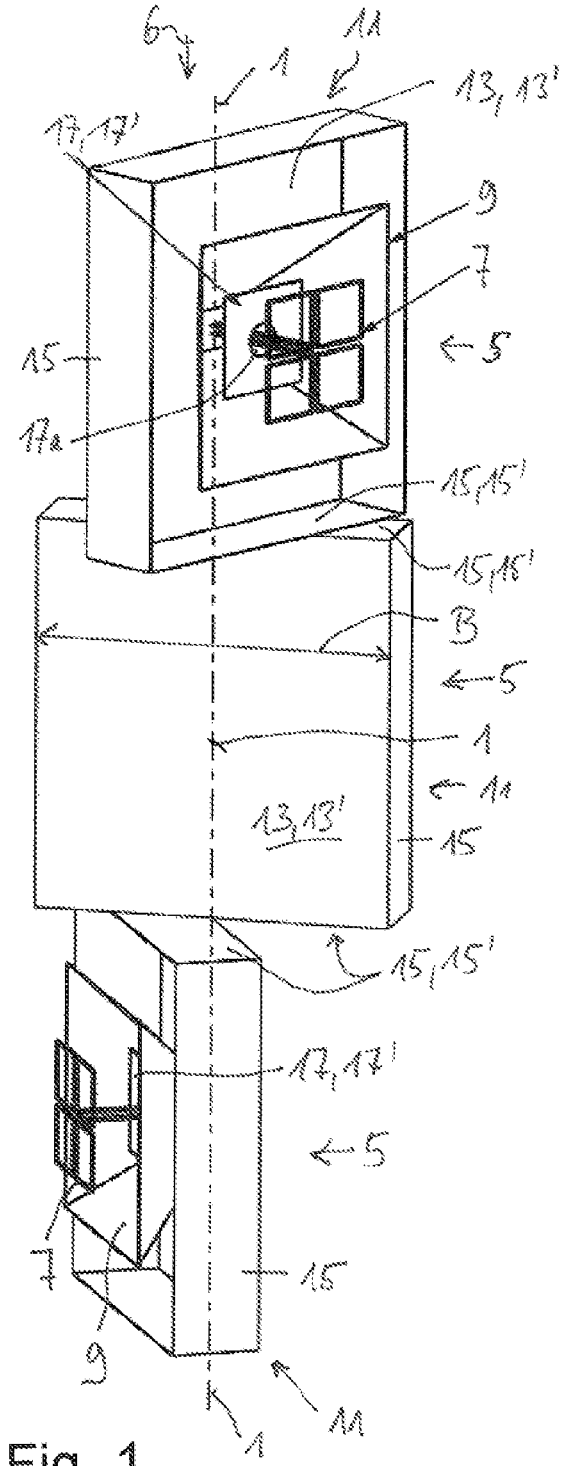
FIG. 1 is a perspective view of a first embodiment according to the invention of an omnidirectional dual-polarised multiband capable antenna.
Figure 4A:
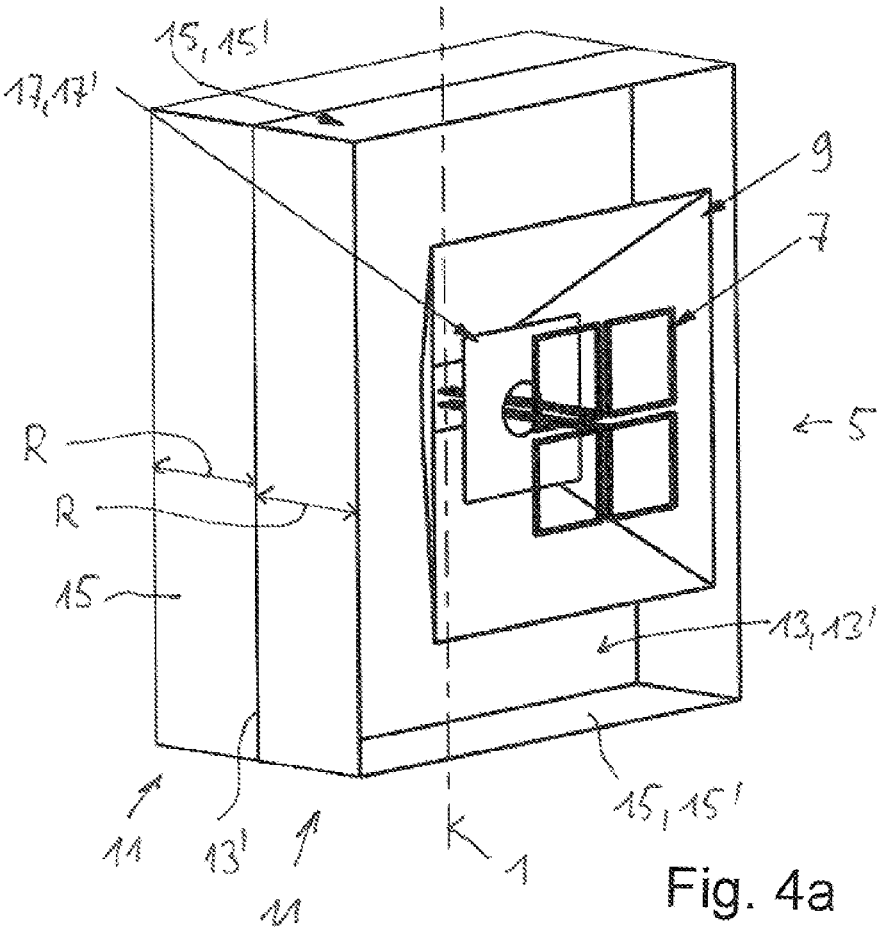
Figure 4B:
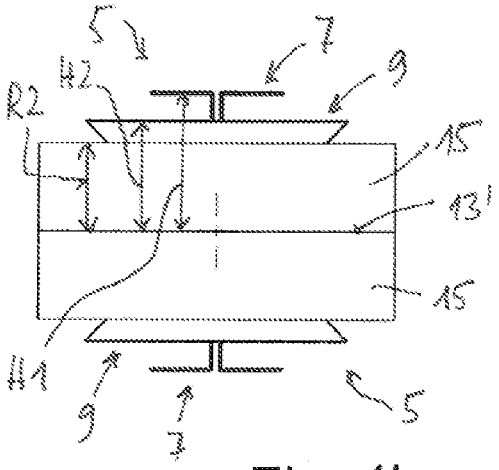
Figure 4C:
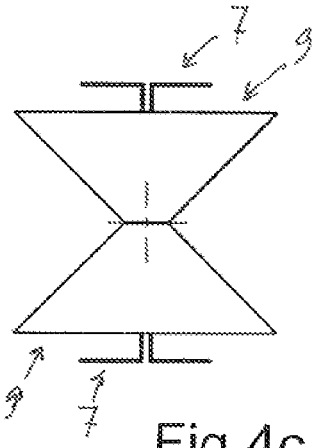
Figure 5:
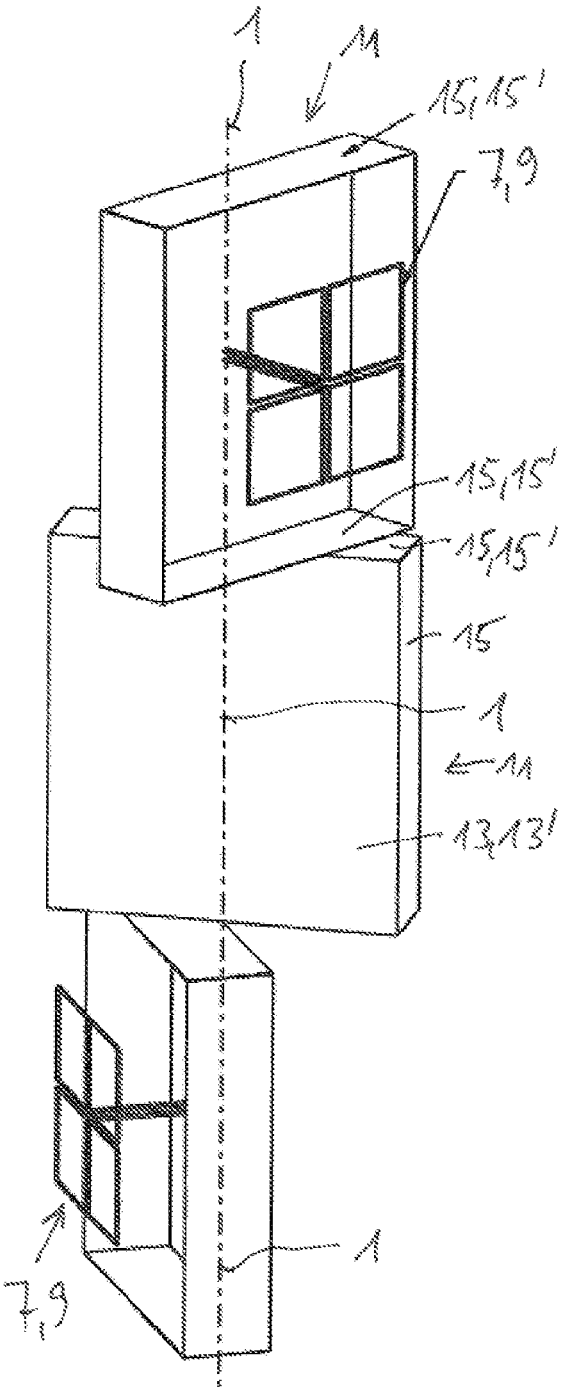
Figure 6:
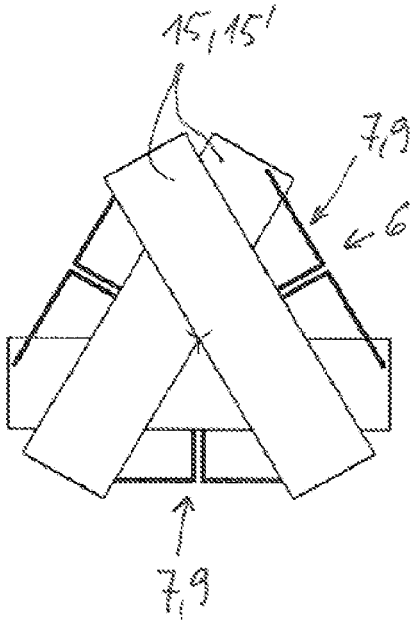
Figure 7:
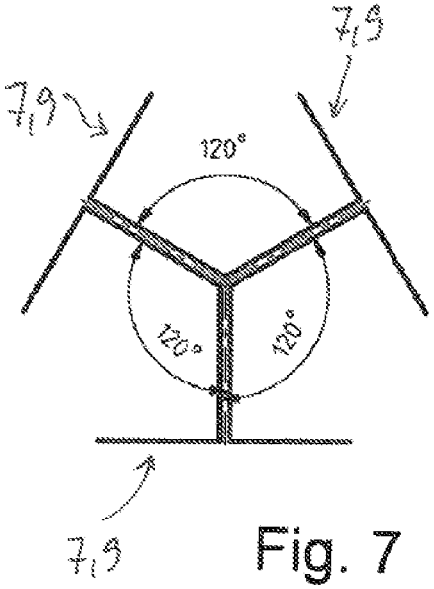
Figure 8:
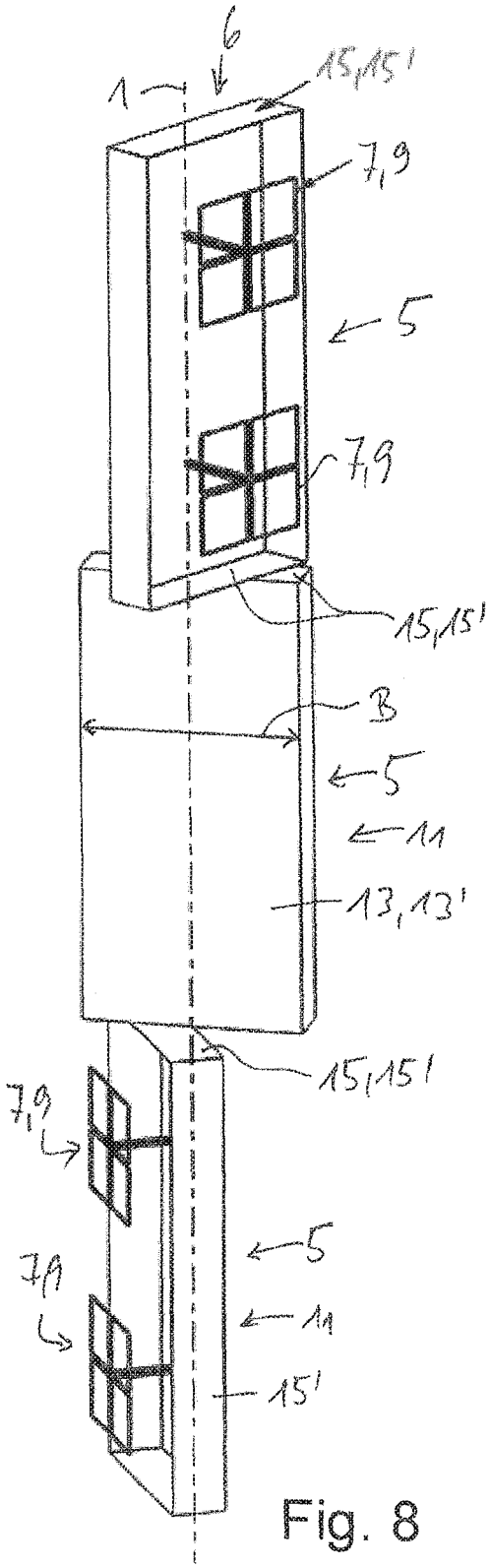
Figure 9:
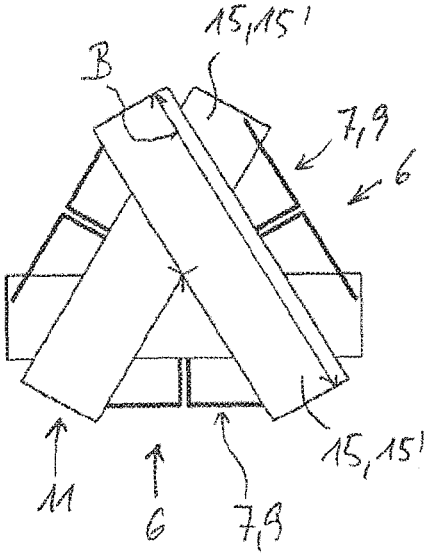
Figure 10:
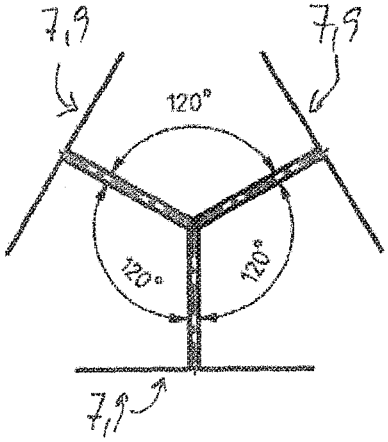
Figure 11:
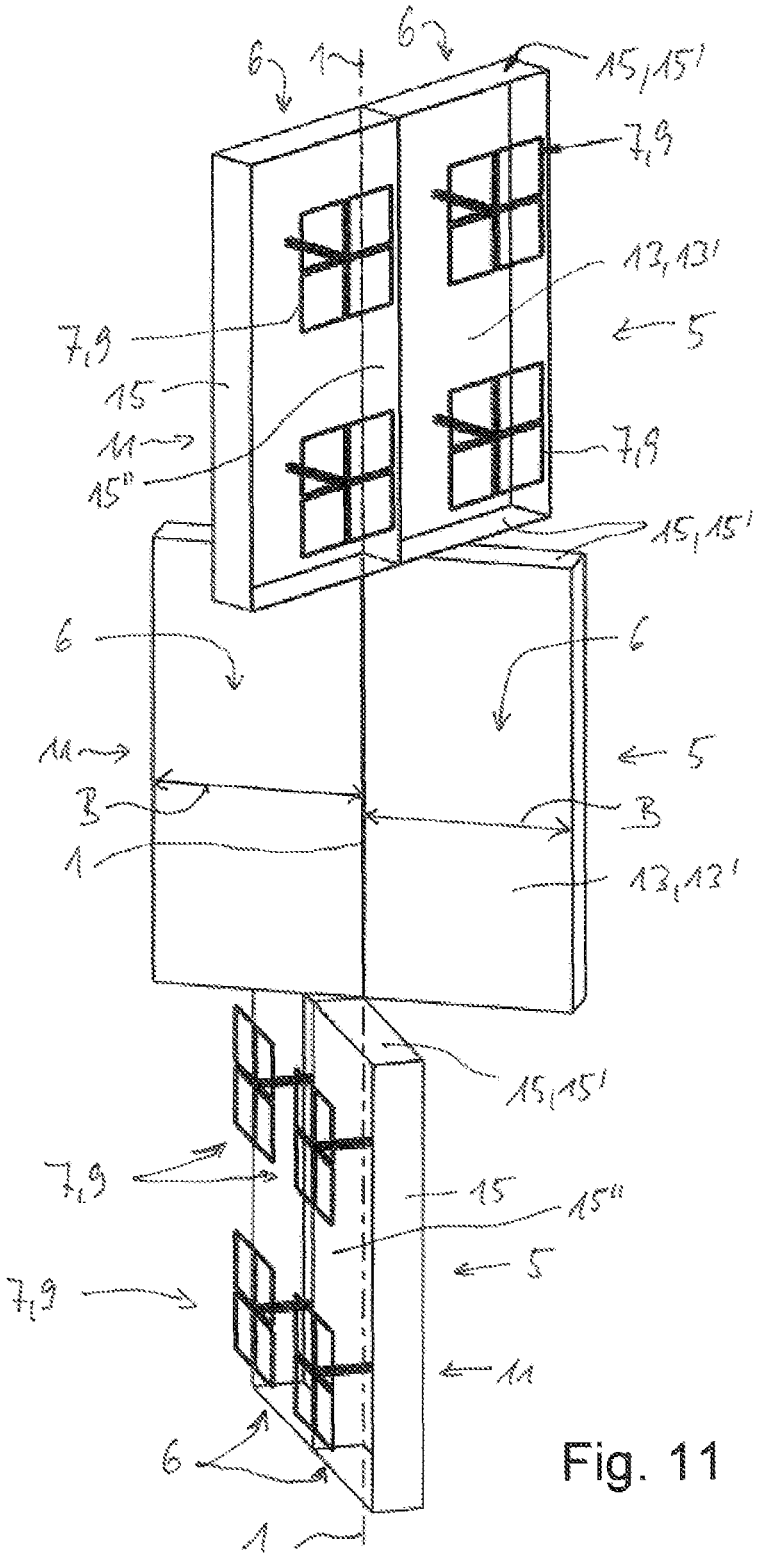
Figure 12:
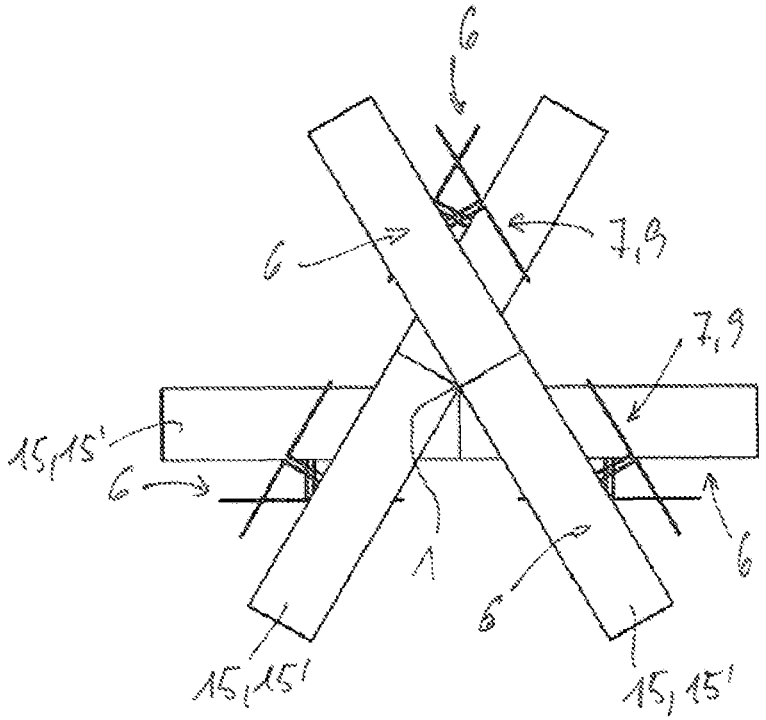
Figure 13:
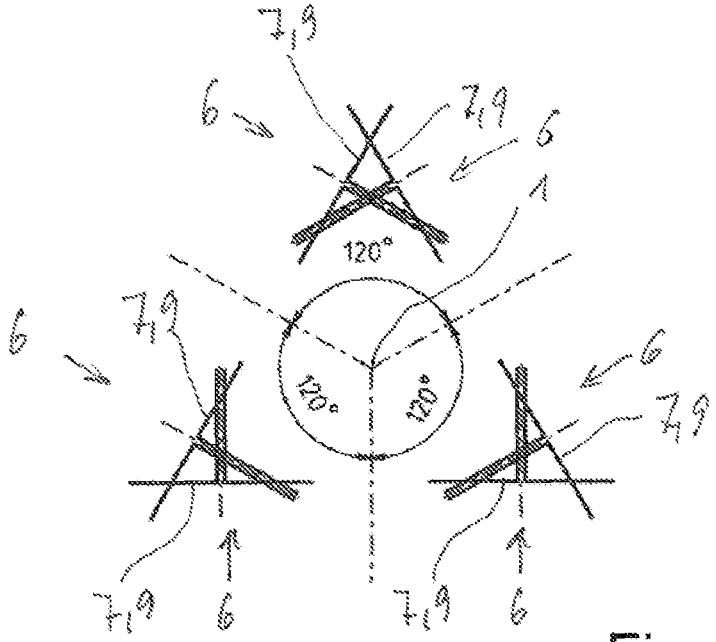
Figure 14:
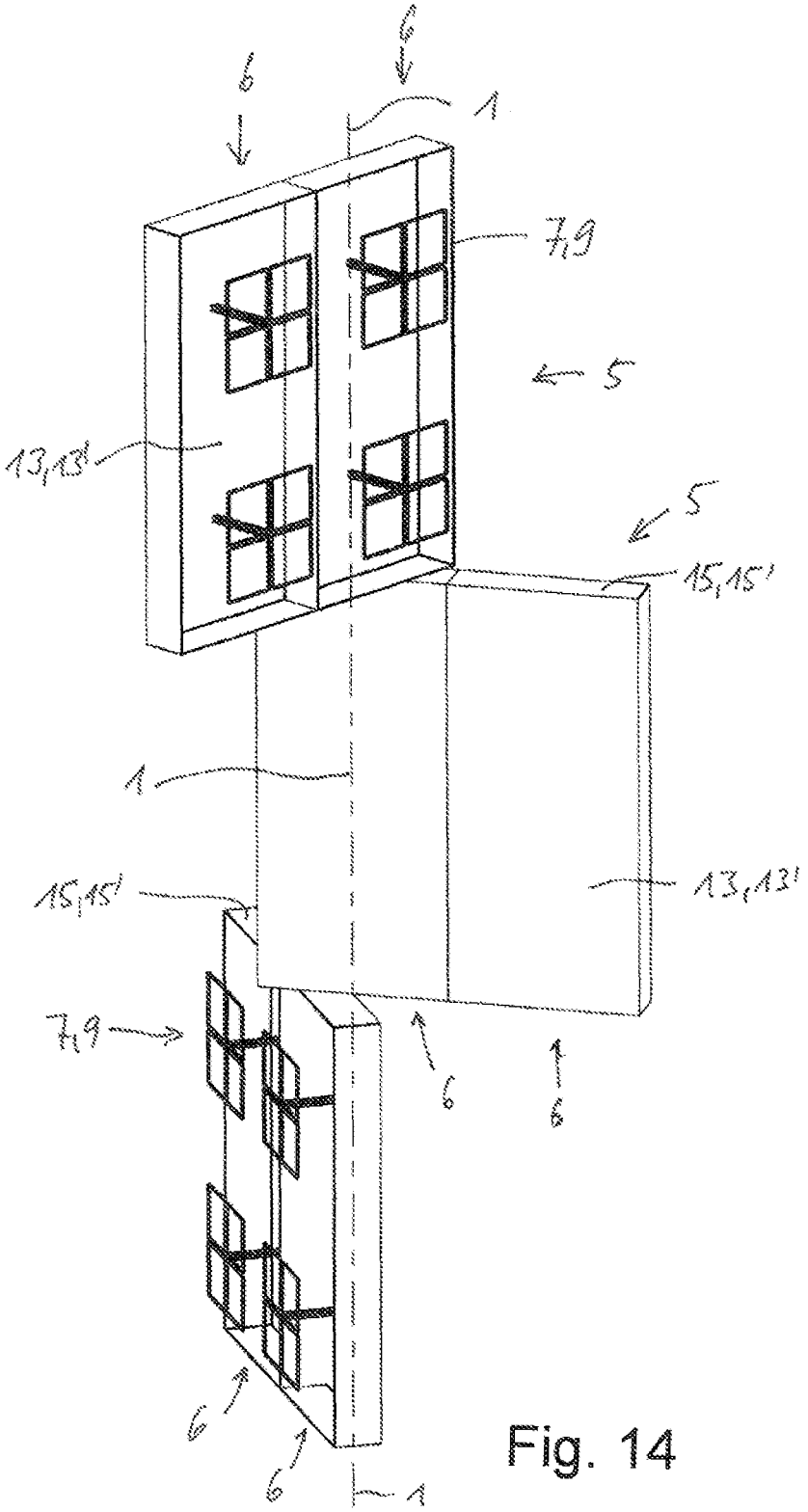
Figure 15:
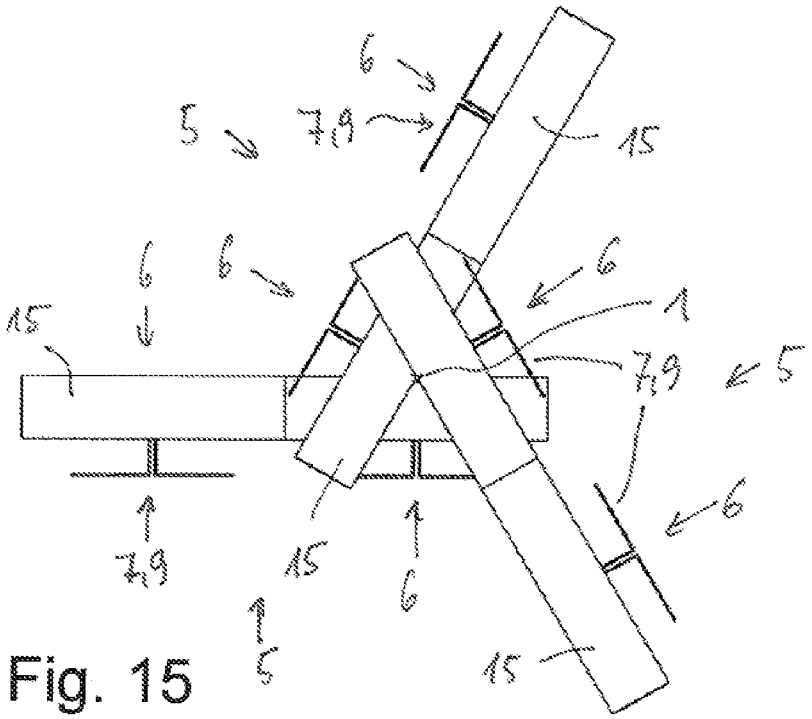
Figure 16:
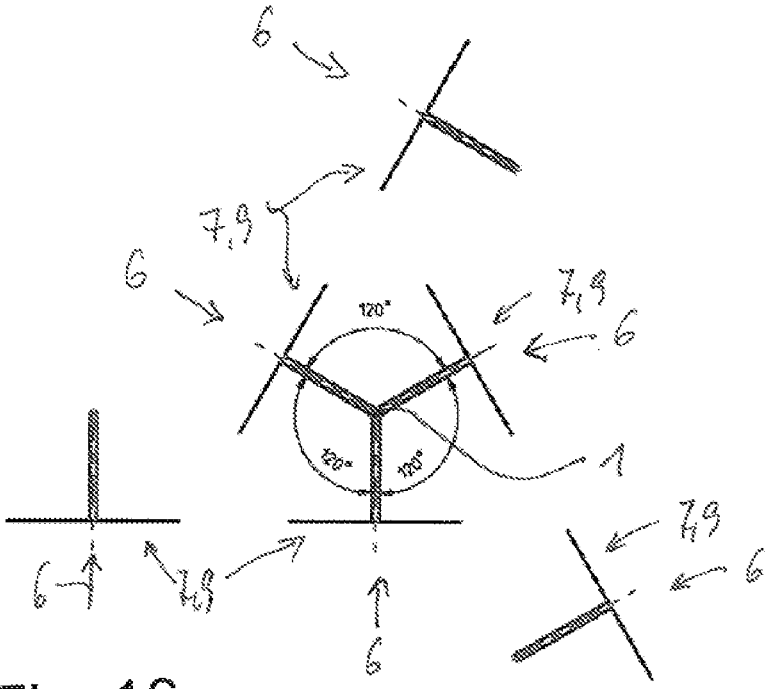
Figure 17:
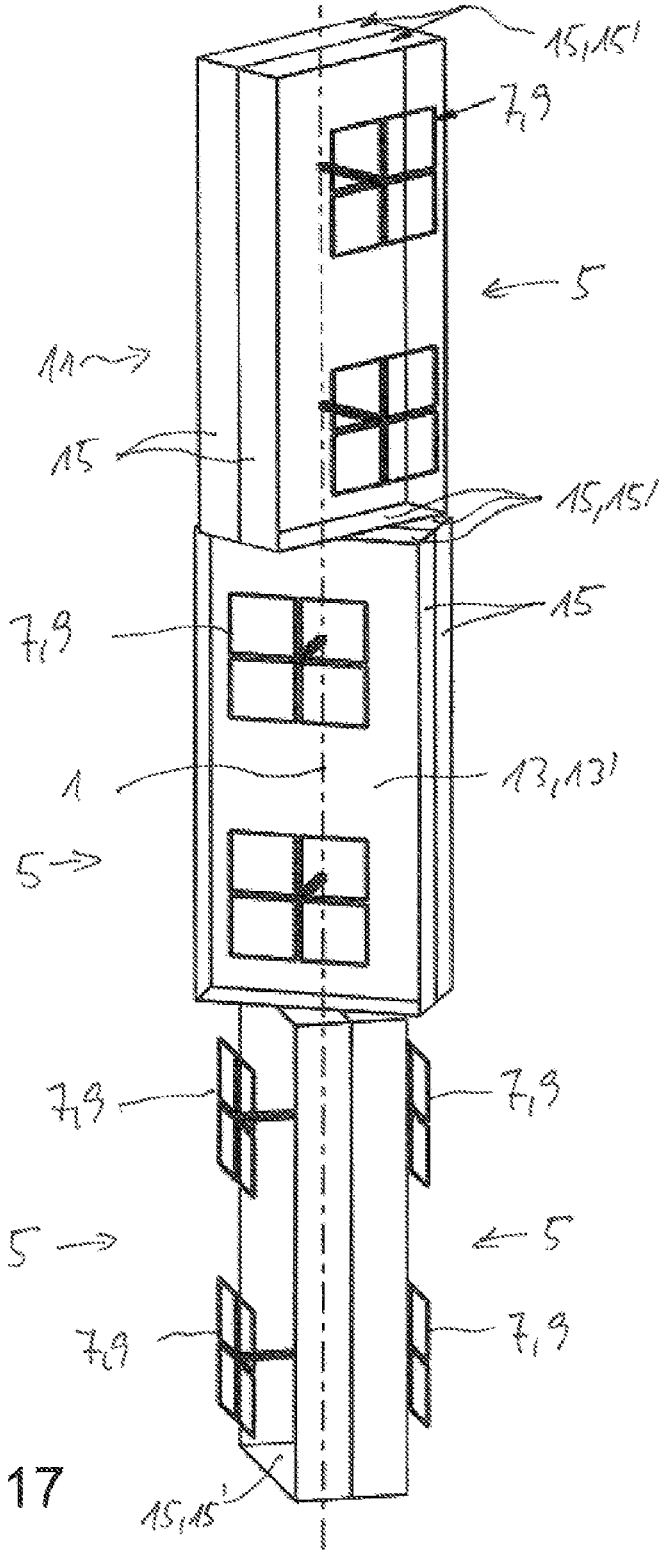
Figure 18:
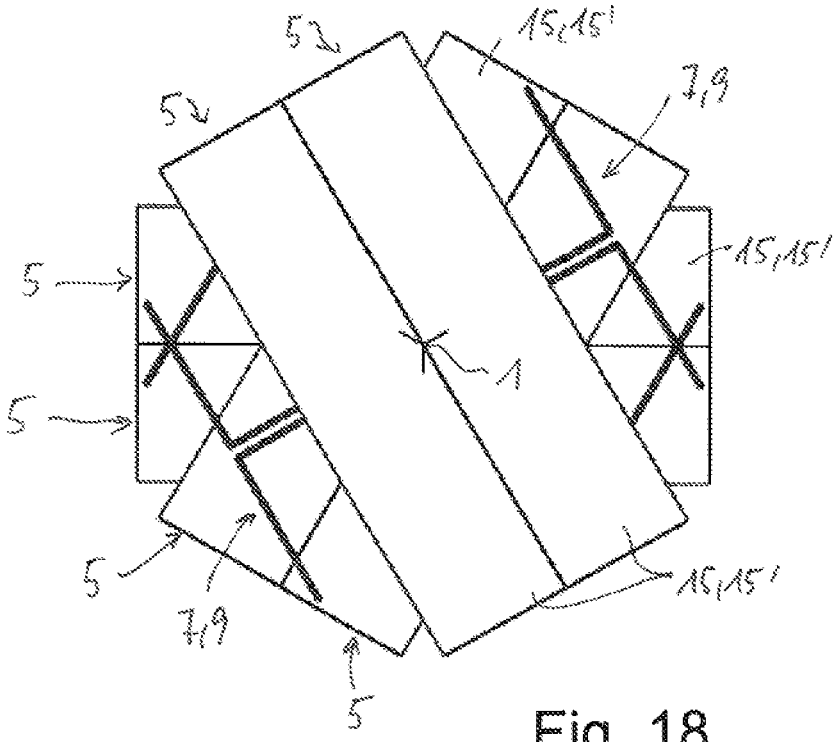
Figure 19:
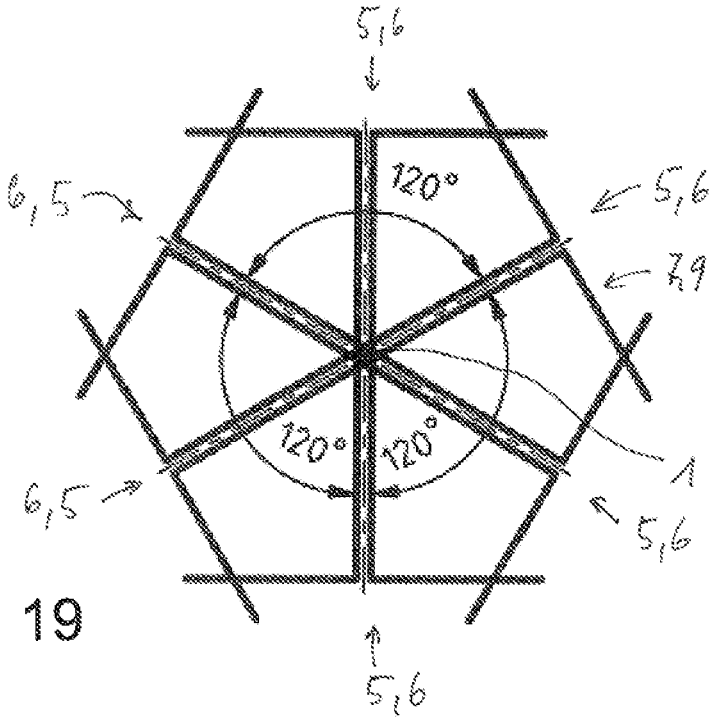
Figure 20:
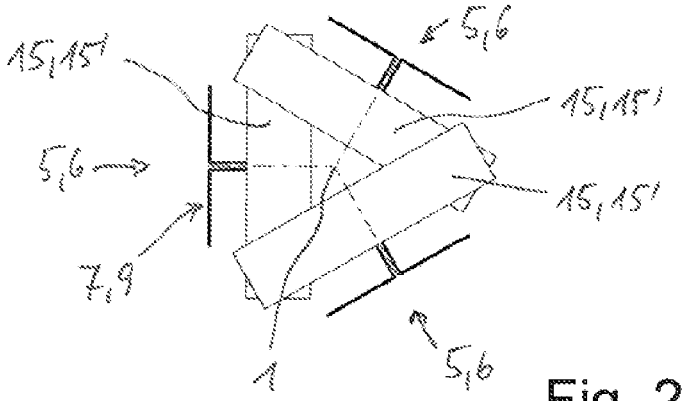
Figure 21:
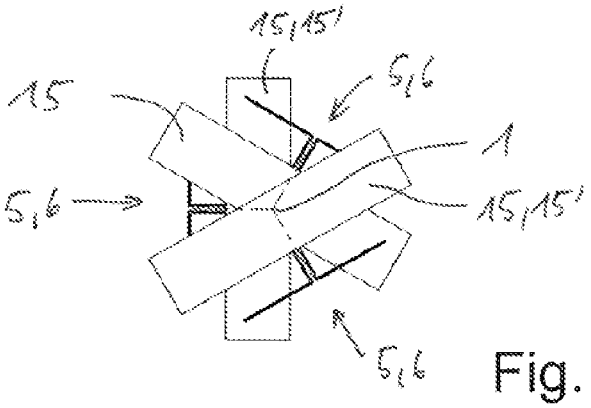
Figure 22:
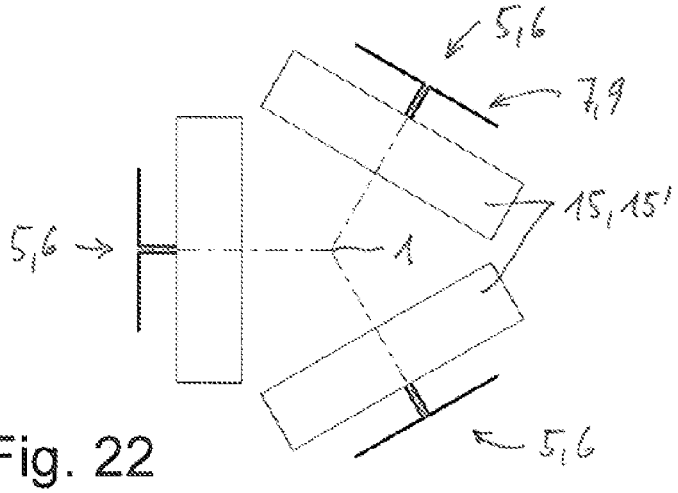
Prior art Fig. 22

FIG. 4*a* is a perspective view of a modified antenna (sector antenna arrangement) comprising two sector antennae which are orientated in opposite directions and which preferably have a shared reflector positioned in a plane of symmetry;

FIG. 4*b* is a plan view of the embodiment according to FIG. 4*a*, but with the reflectors not being shown;

FIG. 4*c* is a drawing corresponding to FIG. 4*b*, but with the reflectors not being shown;

FIG. 5 is a perspective view of an embodiment modified from FIG. 1, relating to an antenna (omnidirectional antenna) having three sector antennae which merely transmit and/or receive in one band;

FIG. 6 is a schematic axial plan view of the embodiment according to FIG. 5;

FIG. 7 is a drawing corresponding to FIG. 6, but with the reflectors not being shown;

FIG. 8 is an embodiment modified from FIGS. 5 to 7, comprising two radiators, arranged mutually offset in the central direction, per single-gap sector antenna;

FIG. 9 is a plan view of the embodiment according to FIG. 8;

FIG. 10 is a view corresponding to FIG. 9, but with the reflectors not being shown;

FIG. 11 is a perspective view of an embodiment modified from FIG. 8, comprising two antenna gaps per sector antenna, in each of which two radiators arranged above one another in the central direction are provided;

FIG. 12 is a schematic axial plan view of the embodiment according to FIG. 11;

FIG. 13 is a drawing corresponding to FIG. 12, but with the reflectors not being shown;

FIG. 14 shows an embodiment modified from FIG. 11, in which the two antenna gaps are positioned laterally transverse to the central axis by comparison with the embodiment of FIG. 11;

FIG. 15 is a schematic axial plan view of the embodiment according to FIG. 14;

FIG. 16 is a view corresponding to FIG. 15, but without the reflectors being shown;

FIG. 17 shows an embodiment modified from the preceding embodiments of an omnidirectional antenna, in which two radiators radiating mutually offset by 180° are respectively provided in each vertical region on the basis of the central axis, and are positioned on a shared reflector wall;

FIG. 18 is a schematic axial plan view of the embodiment according to FIG. 14;

FIG. 19 is a drawing corresponding to FIG. 16, but with the reflectors not being shown;

FIG. 20 is an axial plan view of a modified embodiment differing from the embodiment according to FIG. 6, in which the individual sector antennae are arranged spaced with a small offset from the central axis 1 in the radiation direction;

FIG. 21 is an axial plan view of a further modified embodiment, in which, unlike in FIGS. 6 and 20, the individual sector antennae are arranged with a slight radial offset from the central axis, in such a way that the central axis extends on the radiator side of the sector antennae parallel to the reflector wall rather than on the rear face of the reflectors; and FIG. 22 is a schematic plan view of a corresponding antenna arrangement having three sector antennae which are mutually offset by 120° in accordance with the prior art, in which the sector antennae are arranged in the same vertical position.

In the following, reference is made to FIGS. 1 to 3, which show a first embodiment of the invention.

A vertical central axis 1, drawn in dashes in FIG. 1, is referred to in the following as the installation axis or installation line.

In the embodiment shown, three sector antennae 5 are arranged above one another, and are each orientated mutually offset by 120° in the circumferential direction in terms of the azimuth direction, that is to say radiate mutually offset by 120°.

In this context, it can be seen from the drawings that the three sector antennae 5 are positioned mutually offset in the direction of the vertical central axis or installation line 1, rather than in the same vertical position on the basis of the vertical central axis 1 thereof (as in the prior art).

For this purpose, each of the sector antennae 5 comprises for example a dual-polarised radiator 7, for example for a first, higher frequency band (high band), and a further dual-polarised radiator 9 for a lower frequency band (low band), this sector antenna 5 being arranged in an antenna gap 6.

The vector radiator for the higher frequency band is of a construction which is known in principle for example from EP 1 057 224 B4 or DE 198 60 121 A1.

This dual-polarised radiator for the higher frequency band (also referred to hereinafter as a vector dipole) is arranged for example inside what is known as a cup-shaped dipole, which is also in the form of a dual-polarised radiator and is suitable for transmitting and receiving in a lower frequency band as a result of the larger dimensioning thereof. A radiator of this type is known in principle for example from EP 1 470 615 B1.

The two radiators 7 and 9 are positioned in the same position as viewed from the front perpendicularly on the respectively associated reflector 11, which in the embodiment shown in each case comprises a reflector wall 13, which is to the rear of the reflector and which is arranged in a reflector plane 13', peripheral reflector bars 15 being arranged in the embodiment shown. These reflector bars 15 are positioned transverse and preferably in the embodiment shown perpendicular to the reflector plane 13', and are thus provided as part of the overall reflector 11 as a peripheral boundary. As a result, a decoupling-optimised construction can be provided, that is to say an antenna construction in which a respective sector antenna 5 is optimally decoupled from an adjacent sector antenna located above or below.

Thus, for this purpose, the aforementioned decoupled reflector construction comprises at least one reflector bar 15', which is orientated transverse and preferably perpendicular to the reflector plane 13' of the relevant sector antenna 5 and is thus arranged between two adjacent sector antennae. In this context, this transverse bar 15', predominantly for decoupling from an adjacent sector antenna, of the reflector 11 should extend orientated transverse and in particular perpendicular to the connecting line, that is to say the central axis 1.

In the embodiment shown, a further intermediate reflector 17 can be arranged in an intermediate reflector plane 17', parallel to and at a distance from the rearward reflector wall 13, and dimensioned smaller than the dual-polarised radiator 9 for the low frequency range, the balancer of the corresponding vector radiator 7 passing through a corresponding central opening 17*a* in this intermediate reflector 17 without electric or galvanic contact.

The embodiment shown in a perspective view in FIG. 1 comprises the aforementioned three sector antennae 5, which are orientated mutually offset by 120° in each case in the vertical or central direction 1. The antennae are all basically of the same construction, but they could also differ from another.

In the embodiment shown, each sector antenna 5, that is to say each corresponding antenna system 5, is constructed in the manner of a single-gap sector antenna, which in the embodiment shown also comprises only one series and thus only one corresponding radiator arrangement for transmitting in a higher and lower frequency band. As is shown in the following, two or more sector antennae can also be combined in the vertical direction in a single antenna gap 6 so as to form a corresponding sector antenna array. Moreover, further antenna systems or sector antennae may also be provided, and are positioned in a relatively laterally, radially or horizontally extending installation direction.

In the embodiment shown, in each case the aforementioned vertical central axis 1 is positioned centrally in each of the reflector planes 13' or centrally in each of the reflector walls 13. This ensures that the phase centre of each sector antenna 5, which is generally positioned approximately centrally in the associated reflector plane 13' or in the reflector wall 13 of each sector antenna 5, is positioned on the vertical central axis 1 in an axial plan view, in such a way that a greatly improved omnidirectional radiation pattern, by comparison with the conventional solution, is achieved as a result.

FIG. 4 shows a double individual radiator, that is to say a double sector antenna, which in the embodiment shown can be operated in two frequency bands in each case. This double sector antenna 5 comprises a central reflector 11 with a shared reflector wall 13, which reflector extends perpendicular to the plane of the drawing and is shared in this embodiment, comprising a shared reflector wall 13, which is positioned in the aforementioned shared reflector plane 13'. In other words, in this embodiment the two sector antennae 5 are positioned mutually offset by 180° and thus symmetrically about the reflector plane 13'. The remainder of the construction is provided in such a way that (as in the previous embodiment) each of the two sector antennae which are mounted mutually offset by 180° respectively comprises a (for example cup-shaped) dual-polarised radiator 9 of larger dimensions for the lower frequency band and in the central position thereof a further, also dual-polarised vector radiator 7, optionally again with the additional reflector 17 (not shown in FIG. 4), which is at a distance from the actual reflector plane 13' and is likewise again provided in a reflector plane 17'.

This construction, comprising a double sector antenna 5 orientated mutually offset by 180°, can now be used for each of the three sector antennae shown in FIG. 1, in such a way that with an axial construction of the same height, but also with the same diameter of the antenna arrangement thus formed, six radiators can ultimately be accommodated. This not only improves the omnidirectional radiation pattern but also makes it possible to provide MIMO capability.

In the following, an embodiment according to FIGS. 5 to 7 is discussed, which basically corresponds to the embodiment of FIGS. 1 to 3, but with the difference that, unlike in FIGS. 1 to 3 (which show an omnidirectional antenna using dual-polarised radiators for a dual-band antenna), in this case vector radiators 7 or 9 are provided which can only transmit or receive in one frequency band. In this context, a vector radiator or vector dipole is used such as can be derived for example from DE 10 2004 057 774 B4 for the higher frequency band disclosed therein. All three of the sector antennae 5 shown, which are arranged above one another in the vertical direction along the central axis 1, are thus arranged mutually offset at a 120° angle, as can be seen in particular from the view along the central axis according to FIGS. 6 and 7. In principle, the arrangement may be such that it is possible to transmit and/or receive in any desired frequency band by means of an omnidirectional antenna of this type, and do so for both polarisations. In this case too, other suitable radiator means, such as patch radiators, may be used instead of the dual-polarised vector dipole shown.

FIGS. 8 to 10 develop the aforementioned embodiment in that, although there is still only one antenna gap 6 provided for each sector antenna 5, two dual-polarised radiators 7 or 9, which are positioned mutually offset, are now arranged along the central direction in each antenna gap 6. The distance between the radiators is usually set as a function of the selected frequency band in which the antenna is to transmit and/or receive. This distance is usually between $\lambda/2$ and $\lambda$, for example 0.7 to 0.75$\lambda$, where $\lambda$ may be the central operating frequency of the relevant frequency band. This embodiment is thus a dual-polarised omnidirectional antenna for a single band, in which each sector antenna comprises at least two dual-polarised radiators, which are arranged above one another in the installation direction, generally in the direction of the vertical central axis 1. In other words, it is possible to build on the principle that three, four etc. corresponding radiators are arranged above one another along the central axis. Otherwise, each sector antenna is arranged mutually offset at a corresponding angle about the central axis 1, as shown in FIGS. 9 and 10, as is also the case in the other embodiments.

The described embodiment according to FIGS. 8 to 10 is also shown for a single-band antenna comprising a plurality of dual-polarised radiators arranged above one another along the central axis 1. However, in this case too, the individual sector antennae may be in the form of dual-polarised dual-band or dual-polarised tri-band or in general dual-polarised multiband antennae. If the radiators in the individual sector antennae 5 are to radiate for example in two (or more) frequency bands, a different radiator distance between the individual radiators is usually selected as a function of the operating wavelength, as is known in principle for example from EP 1 082 782 B1 (corresponding to WO 99/062139 A1). This would mean, imitating for example the embodiment according to FIG. 1 or FIG. 8, that for example each sector antenna 5 comprises two dual-polarised radiators 9, spaced apart along the central axis 1, for the lower frequency band, and for example three dual-polarised radiators 7, positioned offset in the same installation direction, for the higher frequency band, for example two dual-polarised radiators for the higher frequency band being positioned in the central position of the two dual-polarised radiators for the lower frequency band 9 (as shown in FIG. 1) if the upper frequency band (for example an 1800 MHz band) is twice as high as the lower frequency band (for example a 900 MHz band), and that the third dual-polarised radiator 7 for the higher frequency band can be arranged between the two centres of the two radiators for the lower or higher frequency band.

In the following, a further modified embodiment according to FIGS. 11 to 13 is discussed, which basically describes three sector antennae 5 which are arranged mutually offset at 120° angles and which are positioned mutually offset along the central axis 1 as in all the other embodiments. Unlike in the previous embodiments, this omnidirectional antenna comprises three sector antennae 5 having dual-polarised radiators which are arranged in two antenna gaps 6 in each case rather than merely being arranged in one antenna gap 6. In this context, at least one or more single-band, dual-band or in general multiband radiators, which are preferably positioned mutually offset in the central direction 1, can be arranged in each antenna gap, as is explained in principle by way of the previous embodiments.

In this context, the reflector 11 with the reflector wall 13 thereof is positioned in a single reflector plane 13' for every two antenna gaps 6 of each sector antenna 5. Corresponding reflector bars 15 are provided for each gap arrangement, and extend around all the radiators 7, 9 associated with an antenna gap, including the aforementioned reflector bars 15', which are orientated transverse to the central axis 1, for achieving decoupling from the next sector antenna. Unlike for example in FIG. 8 or FIG. 11, further transversely extending reflector bars can be provided between the individual radiators 7 or 9 in the individual antenna gaps 6 if required.

In the variant according to FIG. 11, an antenna bar 15" which extends in the central axial direction 1 is also provided between the two antenna gaps.

Again, in this case too, the distance between the central longitudinal axes through each of the antenna bars 6 should correspond to the conventional distance, thus for example between $\lambda/2$ and $\lambda$ with respect to the central operating frequency. Accordingly, suitable values are often between $0.65\lambda$ to $0.75\lambda$, thus for example $0.7\lambda$ (with respect to the central operating frequency if it is a single-band antenna; otherwise, with dual-band antennae, the value of the central frequency for the lower frequency band should be taken as a reference value for $\lambda$).

In the described embodiment, the two antenna gaps 6 are each arranged with respect to a vertical plane of symmetry (positioned perpendicular to the reflector plane 13') in such a way that the vertical central axis 1 extends through the reflector plane 13', specifically precisely at the separating and connecting location between the two antenna gaps 6. That is to say, the respective vertical axis of symmetry 1 extends between the antenna gaps 6 parallel to the associated reflector plane 13'. This results in the phase centres of the sector antennae 5 (along with the radiators in the two gaps 6) appearing, in the far field, to be positioned on or approximately on the central axis 1.

By way of the embodiment according to FIGS. 14 to 16, an omnidirectional antenna is shown comprising two antenna gaps 6 and one or more radiators 7, 9 in the individual gaps 6, in which one antenna gap 6, as in the embodiments according to FIG. 1 to 10, is arranged with respect to the central axis in such a way that the three vertically orientated planes of symmetry (which are perpendicular to the respective reflector plane 13') of the three sector antennae 5, which are arranged above one another in the vertical direction and rotationally offset with respect to one another, intersect on the central axis 1. In this case, the associated respective second antenna gap 6 is in each case laterally offset asymmetrically from the central axis 1, that is to say arranged positioned offset radially outwards, in such a way that in a plan view of FIGS. 15 and 16 a different arrangement appears from that in FIGS. 12 and 13. In other words, in this embodiment too, as in the previous embodiment, it is ensured that at least one additional further radiator 7, 9, arranged in a further antenna gap 6, is provided, that is to say at least one additional radiator 7, 9 which is positioned laterally or radially offset, is provided. In this context, in the embodiment according to FIGS. 11 to 13, as in the embodiment according to FIGS. 14 to 16, the individual sector antennae 5 comprising the at least two antenna gaps shown can be positioned in different positions in the transverse direction, that is to say perpendicular to the central axis 1, that is to say they need not necessarily only be arranged in the position shown in FIGS. 11 to 13 or 14 to 16. Any other different relative positions in a different displacement location perpendicular to the central axis are possible. However, an arrangement is preferred in which, in a plan view of a corresponding sector antenna comprising the at least one or the at least two antenna gaps, the central axis 1 is always positioned in an overlapping position with the sector antenna 5 having one, two or more gaps.

However, intermediate positions, in which the for example two antenna gaps 6 can be positioned in a different position in the horizontal direction relative to the central axis 1, are equally possible within wide ranges.

In the embodiments described above using a plurality of radiators per sector antenna, in particular even when using an antenna construction (antenna array) having two or more gaps, above all MIMO capability of the omnidirectional antenna can be provided or developed and improved. In this context, this improved MIMO capability can be ensured together with optimum omnidirectionality of the radiation pattern.

It was shown by way of FIG. 4 that the number of radiators can be doubled at each position of the sector antenna, in that a corresponding radiator structure is provided on both sides of the reflector 11 or the reflector wall 13, virtually with mirror symmetry about it. However, this principle, which is basically described by way of FIG. 4, can be provided in all the embodiments. This is intended to be shown, merely by way of example, by way of FIGS. 17 to 19, which in principle correspond to the embodiment according to FIGS. 8 to 10, with the peculiarity that the basic idea explained by way of FIG. 4 is provided in this case too. This results in a double radiator arrangement, in which in effect a double sector antenna 5 is provided in each of the three vertical regions, and can comprise one or more single-band or multiband radiators, which are orientated offset in a 180° direction, that is to say counter to one another, in one, two or more gaps, whilst always using dual-polarised or circular-polarised radiators.

As stated, the antenna construction is in principle such that the phase centres of all the gap antennae, that is to say at least the gap antennae which are installed along the central axis 1, generally in sequence in the vertical direction, coincide on the central axis 1 or are at least positioned in the vicinity of the central axis 1. In this context, these phase centres are generally positioned in the reflector plane 13' of the reflector wall 13. Generally speaking, the reflectors 11 and the individual sector antennae thereof are arranged about a central axis 1 in such a way that, in a plan view along the central axis 1, the reflectors 11 and thus also the reflector wall 13 overlap and intersect at least in part. In any case, this distance is significant and preferably smaller by at least half than the conventional distance between the phase centres, that is to say in particular of the reflector plane 13', the reflector walls 13 and the central axis X in conventional omnidirectional antenna arrangements, which in a plan view are of a triangular construction in which the reflector planes are positioned at the sides of an equilateral triangle.

Thus, in the context of the invention, the reflector walls 13, that is to say the respective reflector plane 13', are preferably arranged in such a way with respect to the central axis 1 that the radial distance from the central axis of this reflector wall 13 or the reflector plane 13' is less than 15%, in particular less than 10%, 8%, 6%, 5%, 4%, 3%, 2% and in particular less than 1%, of the gap width B of the respective antenna gap 6 (see FIG. 1, 8 or 11).

Overall, the described embodiments have been described in such a way that the respective reflector plane 13' of a reflector wall 13 of a reflector 11 of each sector antenna 5 is arranged in such a way that the central axis 1 is positioned in the reflector plane 13'. However, the reflectors 11 and reflector walls of the individual sector antennae may also be arranged at a radial distance from the central axis, so as still to provide the advantages according to the invention if this distance is not too great. Therefore, this distance should preferably be less than 15%, in particular less than 10%, 8%, 6%, 5%, 4%, 3%, 2% and in particular less than 1%, of the gap width B of the respective antenna gap 6.

FIG. 20 shows an arrangement of this type of the individual reflectors, in which the respective reflector plane 13' has a radial displacement, which is small in the sense described above, from the central axis 1. An embodiment of this type is conceivable in particular if an antenna mast for example, through which the central axis 1 passes, is to be provided between the three sector antennae in different vertical positions in a plan view.

In the arrangement according to FIG. 21, the individual sector antennae have been offset in a negative direction. Thus, in this case the reflector walls 13 and the associated reflector planes 13' are arranged offset relative to the central axis 1 in such a way that the central axis 1 passes through the reflector bars. Thus, in other words, in this case the central axis extends on the side of the reflector plane 13' on which the radiators 7 and/or radiators 9 are also provided (in the embodiment according to FIG. 20 the central axis extends on the rear side of the reflector walls 13, that is to say on the opposite side from the radiators 7/9).

Purely for completeness, FIG. 22 is an axial plan view of an antenna comprising three sector antennae in accordance with the prior art, in which the three sector antennae 5 are arranged about the central axis at a 120° angle, but in this case all the sector antennae are mounted in the same vertical position, since the reflector walls are at a sufficiently large distance from the central axis 1 that the sector antennae formed in this manner, and in particular the reflectors 11 or reflector walls 13 thereof, do not overlap or intersect in a plan view.

So as to provide the aforementioned decoupling-optimised construction of the individual radiators 5 or the directional antennae 5, that is to say of the one or more sector antennae 5, the aforementioned reflector bars 15 or 15' are provided, which extend transverse and in particular perpendicular to the reflector plane 13' of the reflector wall 13 or of the reflector 11 as a whole. These reflector bars 15 and 15' should preferably be of a reflector bar height R which is greater than 0.05λ, where λ is the central frequency in the case of a single-band radiator. In the case of a dual-band or multiband radiator arrangement, λ is the central frequency of the lowest frequency band. Generally speaking, the height R of the side wall or the side bars 15, 15' of the reflector 11 with respect to the reflector plane 13' should not be greater than the height H1, that is to say the height of the radiators 7 with respect to the reflector plane 13', and should thus also not be greater than the height H2, that is to say the height of the radiators 9 with respect to the reflector plane 13' (see FIG. 4).

Figure 2:
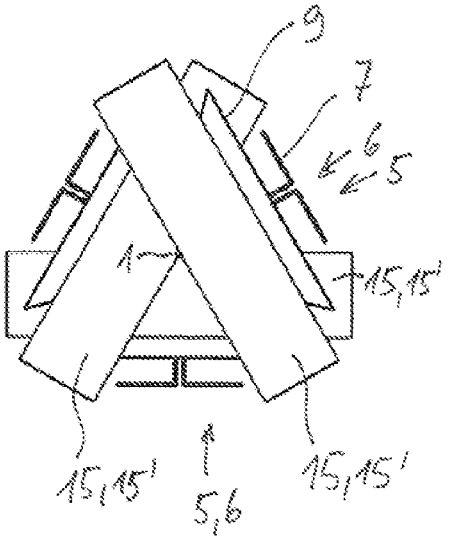
FIG. 2 is a schematic axial plan view of the embodiment according to FIG. 1.
Figure 3:
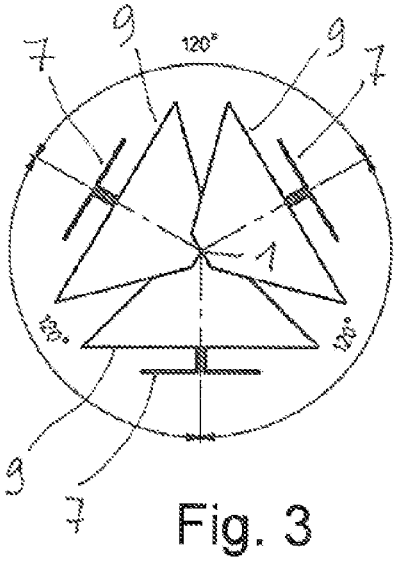
FIG. 3 is a drawing corresponding to FIG. 2, but with the reflectors not being shown.

Thus, in other words, in the embodiment shown the reflector bar height R of the reflector bars 15, 15' and 15" is less than the height H2 of the dual-polarised or vertically polarised dipole or vector radiators 9 for the lower frequency band, and thus also lower than the height H1 of the dual-polarised or vertically polarised radiator 7, which is constructed with an even greater height, for the higher frequency band, as can be seen from FIG. 2 or 4.

In the aforementioned embodiments, the supply system is not discussed in greater detail. Conventionally, the corresponding radiators and antennae are each supplied separately with respect to the two mutually perpendicular polarisation planes and for the one or more frequency bands via coaxial lines. However, combiners/splitters can equally be used, via which the jointly supplied frequencies can be split or combined. In this regard, reference is made to known solutions, and this also applies to the operation of the sector antennae 5 for providing MIMO operation.

It is further noted that the sector antennae associated with the described omnidirectional antenna, which transmit or receive in a single polarisation, can be interconnected via a supply network (this does not apply to sector operation). If radiators which transmit and/or receive in two mutually perpendicular polarisation planes are provided for the sector antennae, all the radiators which are operated in a single polarisation plane (orientated for example at +45° or −45° to the horizontal) can be interconnected via a supply network.

The invention claimed is:

1. A dual-polarized, omnidirectional antenna comprising:

at least first, second and third separate sector antennas which are positioned mutually offset in the circumferential direction about a central axis, each of the first, second and third sector antennas comprising at least one respective antenna gap comprising an associated respective reflector, which is arranged at least in part in an associated reflector plane, each associated reflector having a respective wall, at least one dual-polarized radiator being arranged in the antenna gap in front of the reflectors, and the sector antennas being additionally arranged mutually offset along the central axis thereof, the sector antennas being arranged in such a way that, in an axial view along the central axis, the first, second and third sector antenna reflector walls, arranged in respective reflector planes, of the first, second and third sector antenna reflectors intersect a supply, which is coupled to the associated sector antenna;

wherein the reflector walls or the reflector planes are positioned parallel to the central axis and spaced to the central axis such that the distance between the reflector plane of a sector antenna and the central axis is smaller than 15% of the gap width of a respective antenna gap; and wherein the central axis extends on a side of a said reflector plane on which the dual-polarized radiators are positioned.

2. The dual-polarized, omnidirectional antenna according to claim 1, wherein the reflector walls or the reflector planes are aligned parallel to the central axis in a way that the distance between the reflector plane of an associated sector antenna and the central axis is less than 5% of the gap width (B) of the respective antenna gap.

3. The dual-polarized, omnidirectional antenna according to claim 1, wherein a decoupling means is provided between two adjacent sector antennas which are arranged mutually offset along the central axis.

4. The dual-polarized, omnidirectional antenna according to claim 3, wherein the decoupling means consists of at least one reflector bar which is oriented transverse to the reflector plane of the associated reflector.

5. The dual-polarized, omnidirectional antenna according to claim 4, wherein the height of the reflector bar is greater than 0.05λ on the basis of a central frequency in a single-band antenna or on the basis of a lower central frequency in a dual-band or multiband antenna, and is less than a height of the dual-polarized radiator with respect to the reflector plane of the associated reflector of the associated sector antenna.

6. The dual-polarized, omnidirectional antenna according to claim 4, wherein each sector antenna has a circumferentially closed or interrupted reflector transverse bar, which encloses the reflector together with the sector antenna positioned inside the reflector bar.

7. The dual-polarized, omnidirectional antenna according to claim 1, wherein each sector antenna is in the form of a single-band antenna, a dual-band antenna or a multiband antenna.

8. The dual-polarized, omnidirectional antenna according to claim 1, wherein the second separate sector antenna is oriented through 180°, in the opposite direction, and is provided in the region of each sector antenna, and comprises a shared reflector wall having a shared reflector plane.

9. The dual-polarized, omnidirectional antenna according to claim 1, wherein each sector antenna comprises a plurality of dual-polarized radiators, which are positioned in the antenna gap and arranged mutually displaced in the direction of the central axis.

10. The dual-polarized, omnidirectional antenna according to claim 1, wherein each of the sector antennas comprises at least two antenna gaps which are arranged mutually parallel, at least one dual-polarized radiator and a plurality of dual-polarized radiators being arranged in each antenna gap, mutually spaced in the direction of the antenna gap.

11. The dual-polarized, omnidirectional antenna according to claim 10, wherein the dual-polarized radiators are arranged in the same vertical position in the individual antenna gaps of a said sector antenna.

12. The dual-polarized, omnidirectional antenna according to claim 10, wherein the antenna gaps have a spacing of between 0.65λ and 0.75λ, λ being a central operating frequency for a lowest frequency band.

13. The dual-polarized, omnidirectional antenna according to claim 10, wherein the at least two antenna gaps of each sector antenna are arranged symmetrically about the central axis.

14. The dual-polarized, omnidirectional antenna according to claim 9, wherein each of the sector antennas is arranged in such a way that in each case an antenna gap is positioned symmetrically about the central axis, while the antenna gaps are positioned radially, laterally or transversely with respect to the central axis.

15. The dual-polarized, omnidirectional antenna according to claim 1, wherein a plurality of dual-polarized radiators which are arranged in the at least one respective antenna gap, the plurality of dual-polarized antennas being operable as MIMO antennas.

16. The dual-polarized, omnidirectional antenna according to claim 1, wherein the dual-polarized radiator is single-band, dual-band or multiband-capable.

17. The dual-polarized, omnidirectional antenna according to claim 4, wherein the reflector walls with the associated reflector planes are spaced apart in relation to the central axis such that the central axis crosses the reflector bar.

18. An antenna comprising:

a radiator supply structure;

at least first, second and third separate sector antennas coupled to the radiator supply structure, the first separate sector antenna comprising at least one first antenna gap comprising an associated first reflector arranged at least in part in a first reflector plane, the associated first reflector having a first wall;

the second separate sector antenna comprising at least one second antenna gap comprising an associated second reflector arranged at least in part in a second reflector plane, the associated second reflector having a second wall;

the third separate sector antenna comprising at least one third antenna gap comprising an associated third reflector arranged at least in part in a third reflector plane, the associated third reflector having a third wall;

the at least first, second and third separate sector antennas being arranged to be mutually offset in the circumferential direction about a central axis in such a way that, in an axial view along the central axis, the first, second and third reflector walls are arranged in a plane of the first, second and third reflectors to intersect the radiator supply structure, wherein the central axis runs on a side of the first, second and third reflector planes of the first, second and third reflectors, respectively;

the first, second and third reflector walls or the first, second and third reflector planes being positioned parallel to the central axis and spaced to the central axis such that the distance between each reflector plane of an associated sector antenna and the central axis is smaller than 15% of the gap width of the respective antenna gap of said sector antenna, at least one dual-polarized radiator being disposed in the at least one antenna gap, and wherein the central axis runs on a side of the first, second and third reflector planes of the first, second and third reflectors on which the dual-polarized radiator is positioned.

19. An antenna comprising:

a radiator supply structure;

at least first, second and third separate sector antennas coupled to the radiator supply structure, the first separate sector antenna comprising at least one first antenna gap comprising an associated first reflector arranged at least in part in a first reflector plane, the associated first reflector having a first wall;

the second separate sector antenna comprising at least one second antenna gap comprising an associated second reflector arranged at least in part in a second reflector plane, the associated second reflector having a second wall;

the third separate sector antenna comprising at least one third antenna gap comprising an associated third reflector arranged at least in part in a third reflector plane, the associated third reflector having a third wall;

the at least first, second and third separate sector antennas being arranged to be mutually offset in the circumferential direction about a central axis in such a way that, in an axial view along the central axis, the first, second and third reflector walls are arranged in a plane of the first, second and third reflectors to intersect the radiator supply structure, wherein the central axis runs on a side of the first, second and third reflector planes of the first, second and third reflectors, respectively;

the first, second and third reflector walls or the first, second and third reflector planes being positioned parallel to the central axis and spaced to the central axis such that the distance between each reflector plane of an associated sector antenna and the central axis is smaller than 15% of the gap width of the respective antenna gap of said sector antenna, wherein each of the first, second, and third separate sector antennas have a double sector antenna with a shared reflector wall.

* * * * *